United States Patent [19]

Lasch et al.

[11] Patent Number: 4,749,455

[45] Date of Patent: Jun. 7, 1988

[54] METHOD OF TREATING CONTAMINATED AQUEOUS PHOSPHORIC ACID SOLUTIONS

[75] Inventors: Manfried Lasch; Norbert Eickelpasch; Hans-Peter Mies; Wolfgang Stang, all of Gundremmingen, Fed. Rep. of Germany

[73] Assignee: KGB Kernkraftwerke Gundremmingen Betriebsgesellschaft mbH, Gundremmingen, Fed. Rep. of Germany

[21] Appl. No.: 90,958

[22] Filed: Aug. 28, 1987

[30] Foreign Application Priority Data

Sep. 20, 1986 [EP] European Pat. Off. ..... 86112992.2

[51] Int. Cl.[4] ..... C25F 3/02

[52] U.S. Cl. ..... 204/129.9; 204/141.5

[58] Field of Search ..... 204/129.9, 129.95, 140, 204/141.5, 145 R

[56] References Cited

U.S. PATENT DOCUMENTS 4,615,776 10/1986 Sasaki ..... 204/129.1

4,701,246 10/1987 Fujita ..... 204/141.5

FOREIGN PATENT DOCUMENTS 204900 10/1985 Japan ..... 204/129.9

*Primary Examiner*—T. M. Tufariello

*Attorney, Agent, or Firm*—Karl F. Ross; Herbert Dubno

[57] ABSTRACT

Phosphoric acid solution used in the decontamination of radioactive metal articles is reacted with oxalic acid to precipitate the iron oxalate which is then pyrolyzed to form a mixture of oxides in small volume for storage as a radioactive waste. The solution from which the oxalate is removed is evaporatively concentrated and reused for decontamination.

20 Claims, No Drawings

METHOD OF TREATING CONTAMINATED AQUEOUS PHOSPHORIC ACID SOLUTIONS

FIELD OF THE INVENTION

Our present invention relates to a method of treating a contaminated aqueous phosphoric acid solution which may be substantially completely saturated with iron, as derived from a chemical and/or electrochemical decontamination of metallic components having radioactive surface contaminants. Chemical decontamination, as this term is used herein, will be understood to refer customarily to a pickling operation.

BACKGROUND OF THE INVENTION

Phosphoric acid electrolyte baths for electrochemical decontamination have been used for several years. After long term usage, such baths show an increased iron content and activity in the electrolyte sleuthing. With iron concentrations in excess of 100 g Fe/l, further use of the electrolyte becomes uneconomical because the decontamination processes are very time consuming and labor intensive. Accordingly, the electrolyte must be discarded.

When the baths are used to decontaminate radioactive metallic articles, they become radioactively contaminated themselves and thus must be stored and contained with the precautions associated with radioactive materials.

Two principal techniques have been used heretofore for the treatment of radioactively contaminated aqueous phosphoric acid electrolytes.

In one approach the phosphoric acid electrolyte, containing about 30 to 40% phosphoric acid, is diluted some 50 times with water. This is necessary to prevent, during the subsequent neutralization with sodium hydroxide, a precipitation of the $Na_3PO_4.12\ H_2O$.

In a second step, the sodium hydroxide is added with intensive stirring to a pH of the solution of 7. During the neutralization, the previously soluble iron phosphate precipitates as a sediment from which the liquid phase is easily decanted.

The iron phosphate precipitate binds the greater part of the radioactivity to it so that the supernatent sodium phosphate solution has a radioactivity which lies below the limits which require consideration of the waste water as radioactive.

Nevertheless the water can be subjected to further sedimentation and flocculation processes. This approach has the advantage that for 3000 liters of an electrolyte bath, only about 1000 kg of iron phosphate must be subjected to conditioning and storage as a radioactive waste. Its drawback, however, is that the radioactive waste water from a 3000 electrolyte bath contains about 1800 kg of sodium phosphate which is equivalent to about 1500 kg of phosphate ion, a significant environment contaminant when this waste water is disposed of.

The more common approach, therefore, provides for evaporation concentration of the electrolyte solution. To protect the evaporator and prevent deposits from forming since the solution treated otherwise has caking tendencies, the acid must be neutralized to a solution of about pH 10. As a result, this method produces a mixture of the $Na_3\ PO_4.12\ H_2$ and iron phosphate. For a 3000 l charge of the electrolyte bath, therefore, some 1000 kg of the dodeca hydrate of sodium authophosphate must be conditioned.

While this process is less prone to environmental contamination because of the release of phosphates, it nevertheless must deal with the storage and processing as radioactive wastes of large amounts of solid residue.

OBJECTS OF THE INVENTION

It is, therefore, the principal object of the present invention to provide a method of treating substantially iron-saturate radioactively contaminated aqueous phosphoric acid solutions of the aforedescribed type to minimize the radioactive materials which have to be conditioned and stored and at the same time avoid environmental contamination with other pollutants.

Another object of the invention is to provide an improved method of decontaminating superficially radioactively contaminated surfaces of metal objects with the same goal.

DESCRIPTION OF THE INVENTION

The decontamination method utilizes preferably electrochemical decontamination of metal parts or components which have radioactively contaminated.

Electrochemical decontamination has been found to be the most economical in the past because for small parts and complex geometry, electrochemical decontamination is most effective. Decontamination using either the electrochemical route or simple chemical pickling are found to be techniques which can be utilized effectively to remove superficial radioactive contaminants from metal parts and thereby minimize, by localizing the radioactivity in the bath, general contaminants of the environment.

Naturally, with increasing utilization in both cases, the activity in the acid baths progressively increases and the iron content of the baths increases as well. According to the invention, the depleted or consumed aqueous phosphoric acid solution, in which a further increase in the iron content is no longer acceptable and/or whose radiation activity has reached a maximum level, is combined with an oxalic acid solution to substantially quantitatively precipitate iron oxalate from the combined solution. The iron oxalate is recovered and conditioned by pyrolysis while the remaining phosphoric acid solution is evaporatively concentrated to a phosphoric acid concentration of 15 to 65 weight percent and is used for the decontamination of other components.

The pyrolyzed iron oxalate leaves as a residue for radioactive storage predominantly iron and, since the solution is reused, the radioactive wastes which must be processed and stored are a minimum and there is no danger of contaminating the environment with phosphate solutions.

According to a feature of the invention, an especially high degree of iron removal is obtained when the phosphoric acid solution before combining it with the oxalic acid solution is subjected to a reducing treatment wherein up to or at least 80% of the iron is converted into its divalent form.

According to the invention, in a preferred embodiment, the reducing treatment is carried out electrochemically in a stainless steel vessel connected as the cathode against an immersed diaphragm-surrounded graphite anode.

The reduction can be carried out also by utilizing the electrolytic bath without the application of an electric current as pickling type decontamination solution. In this case, a certain degree of reduction occurs without electrochemical augmentation. This process is best used when many small objects require treatment.

The precipitation of the iron oxalate has been found to be most effective when the depleted phosphoric acid solution is fed to a cold oxalic acid solution.

Best results are obtained when the oxalic acid solution has an oxalic acid content of 5 to 15 weight percent, preferably 10 weight percent.

The iron oxalate can be separated by sedimentation and/or filtration. It has been found to be advantageous and an important energy-saving measure to dry the recovered iron oxalate before the pyrolysis thereof.

The residual phosphoric acid solution is evaporatively concentrated most preferably to a phosphoric acid content of about 40% because the phosphoric acid of this concentration can be used directly both for chemical decontamination (pickling) and for electrochemical decontamination. The water vapor which is released by the evaporative concentration of the phosphoric acid solution can be condensed and the condensate used for the preparation of fresh oxalic acid solution.

In the process of the invention, one begins with the solution of removable components, e.g. of a nuclear electricity generating power plant which can be successively subjected to pickling or electrochemical decontamination in an acid bath. The parts usually will be disassembled to easily handle the pieces. The decontamination is carried out either by chemical pickling in 40% phosphoric acid solution at 60° C. or by electrochemical decontamination in the 40% phosphoric acid connecting the component to be decontaminated as the anode. In the latter case, the voltage generally will be 15 volts, the cathode a stainless steel vessel containing the bath and the current from 1000 to several thousand amperes. The current falls off with increasing temperature and iron content.

Since the electrolyte is heated by the current flow, it is provided in heat exchange with cooling water capable of stabilizing the temperature at about 70° C.

In both pickling and electrochemical decontamination, there is some surface attack on the metal workpieces and some solubilization thereof.

Gaseous hydrogen is formed at the surface during pickling and gaseous oxygen is produced at the surface during electrochemical decontamination, these gaseous products reinforcing the chemical action which mechanically and chemically removes the corrosion layer adherent to the surface. The latter layer is found to have the radioactivity which superficially contaminated the workpieces.

The workpieces can then be removed from the bath and sprayed or otherwise rinsed with deionized water. The workpieces are then tested for residual activity and if any residual activity beyond a permissible limit is found, the article can be returned to the bath. Otherwise the article can be handled in a conventional manner as if it is no longer radioactive. The phosphoric acid cycle, therefore, begins with the aforedescribed pickling or electrochemical decontamination operation. The electrolyte or bath picks up significant quantities of iron (up to 100 g/l), thereby leading to a reduction in the effectiveness of the solution.

After saturation with iron, the electrolyte is transferred into a storage vessel and if the divalent iron preparation of the total iron is less than 80%, the solution is subjected to a radioactive treatment.

The radioactive treatment is preferably carried out electrochemically in a stainless steel vessel which is formed as the cathode while a graphite anode is immersed in the solution, surrounded by a diaphragm. A direct current is applied to the resulting cell and the trivalent iron is transformed to the divalent iron at the vessel wall while $O_2$, $CO_2$ and CO are generated at the cathode. This results in gradual consumption of the anode.

When reduction is terminated, with a divalent iron proportion of at least 80%, the electrolyte is introduced into a reaction vessel in which approximately the same volume of cold oxalate acid solution has already been provided. The two solutions are mixed together thoroughly. The precipitation of iron oxalate $FeC_2O_4.2H_2O$ begins within a minute and with thereover stirring, the settling of the precipitate is prevented.

After a thorough mixing, the suspension is pumped into a cylindrical plastic receptacle, the bottom of which is provided with a filter basket.

For several hours the precipitate is permitted to sediment in this receptacle and to collect in the filter basket.

The clear supernatent solution is then immediately introduced into the phosphoric acid evaporator or is delivered thereto after removal of residual suspended solid particles, e.g. in a second filter basket through which the solution is pumped.

In the evaporator, the low-iron electrolyte is heated until water distills off at a boiling temperature of about 102° C. Evaporative concentration is continued until the phosphoric acid content amounts to 40 to 65 weight percent. The electrolyte is then again ready for use either for pickling or for electrochemical decontamination and is recycled to the decontamination stage.

The water also circulates in a closed cycle.

All of the water fed to the storage vessel can be derived from the condensation at the evaporator. It may be used to rinse the workpieces after pickling, to form the oxalic acid solution and to wash the iron oxalate. The rinse water used to spray the workpieces and which may be contaminated by iron phosphate and phosphoric acid, also can be used in the production of the oxalic acid solution.

The solid oxalic acid (oxalic acid dihydrate $H_2C_2O_4.2H_2O$) is reacted at room temperature with the appropriate quantity of this water to form a 10% oxalic acid solution. This is stored in a supply vessel and is reacted as described with the reduced electrolyte. After several washings, practically phosphoric acid-free iron oxalate is dried and subjected to pyrolysis.

The pyrolysis can involved heating the iron oxalate to a temperature above about 250° C. The thermal decomposition of the iron oxalate at such temperatures produces a mixture of the iron oxides (FeO, $Fe_2O_3$ etc.) which can be either filled into cast casks or after mixing with hydraulic cement and water filled into iron-hooped casks for storage.

The gases generated during pyrolysis (CO, $CO_2$, water vapor) are passed over a catalyst in which the CO is transformed to $CO_2$. The water can be condensed and combined with the condensate described above. The carbon dioxide can be processed and monitored together with the gases resulting from the electrochemical decontamination, pickling and reduction stages ($H_2$, water vapor, $O_2$ and CO and $CO_2$ from the graphite anode) so that it can be certain that no gases of excess residual activity will be released into the atmosphere.

EXAMPLE

A depleted phosphoric acid solution from electrochemical decontamination and pickling of radioactively contaminated metal parts, of which 10% of the iron content derives from pickling, is processed. The solution corresponds to the contents of a 3000 l electrolyte to be regenerated after it had been used with an original phosphoric acid concentration of 40% for six to seven weeks to decontaminate 24 metric tons of material. The iron concentration was 20 g/l From the pickling two tons of solution was obtained, corresponding to 250 l of the phosphoric acid solution was obtained. In the electrochemical process with an approximate current efficiency of 50%, the current utilization was 42,200 ampere hours at an average of 15 volts and a power consumption of 6,330 kilowatt hours.

For the electrochemical decontamination and pickling per bath and per week, 500 l of phosphoric acid was consumed corresponding in six to seven weeks to 3 $m^3$. As noted, the mass of the decontaminated articles was 24 tons. The iron which had to be processed corresponded to 240 kg in the phosphoric acid solution part of which was returned to the latter from the rinsing water. Approximately 100 g per l of iron was present in the depleted batch which was processed according to the invention, part deriving from iron fed to the bath from the rinse water. The divalent iron content at the start was approximately 30% of the iron.

The reduction was carried out electrochemically utilizing the graphite anode and stainless steel vessel cathode described at a voltage of 15 volts. The current efficiency was 50% and 201,500 ampere hours was utilized.

The iron was 100% converted to the divalent form. 542 kg of the oxalic acid dihydrate was dissolved in 4,500 l of water, partly derived from the rinse water and partly from the condensation after evaporative concentration of the phosphoric acid. 3,000 l of the depleted electrolyte and 4,500 l of the cold oxalic acid solution were combined in 3 and 3¾ portions each in a 2 $m^3$ reaction vessel.

773 kg of the iron oxalate $FeC_2O_4.2H_2O$ precipitates and approximately 206 kg per filling of the reaction vessel of iron oxalate is collected in the filter basket.

The iron oxalate is then washed in water in an amount up to 1,000 l and the wash water is returned to the solution from which the iron oxalate is separated. The total volume of this decanted/filtrate is 7.5 $m^3$ and approximately 1 $m^3$ of wash water is added thereto. The total volume of the solution subjected to evaporative concentration is 8.5 $m^3$.

This 8.5 $m^3$ of solution is evaporatively concentrated in 8 fillings of the evaporator to 3 $m^3$ over a period of 35 hours, about 5.5 $m^3$ of water being distilled. The distillate recovery averages during maximum heating effectiveness about 158 l per hour.

The pyrolysis of the dried iron oxalate (773 kg and 0.6 $m^3$) at a temperature of about 300° C. yields a mixture of iron oxides which is 56% lighter (343 kg and about 0.3 $m^3$) which is stored as described. The concentrated phosphoric acid with a phosphoric acid content of 40% is recycled to the pickling and electrochemical decontamination stages.

We claim:

1. A method of treating a radioactive substantially iron-saturated aqueous phosphoric acid solution from the chemical or electrochemical decontamination of superficially radioactively contaminated metal components, said method comprising the steps of:

(a) combining a radioactive substantially iron-saturated aqueous phosphoric acid solution from the chemical or electrochemical decontamination of superficially radioactively contaminated metal components with an aqueous oxalic acid solution and precipitating iron oxalate from a liquid phase of the combined solutions;

(b) recovering the precipitated iron oxalate from the combined solutions of step (a);

(c) conditioning the iron oxalate recovered in step (b) by pyrolysis to form a storable residue, and storing said residue;

(d) subjecting the liquid phase from step (a) from which the precipitated iron oxalate is recovered to evaporative concentration of the phosphoric acid therein and to form a recovered phosphoric acid solution with a phosphoric acid content of substantially 15 to 65 weight percent; and (e) decontaminating further superficially radioactively contaminated metal components with the recovered phosphoric acid solution of step (d).

2. The method defined in claim 1, further comprising the step of subjecting the radioactive substantially iron-saturated aqueous phosphoric acid solution from the chemical or electrochemical decontamination of superficially radioactively contaminated metal components prior to step (a) to a reductive treatment for converting up to at least 80% of the iron therein to its divalent form.

3. The method defined in claim 2 wherein the reduction is carried out electrochemically in a stainless steel vessel connected as a cathode against a graphite anode immersed in the radioactive phosphoric acid solution and surrounded by a diaphragm.

4. The method defined in claim 1 wherein, in step (a), the radioactive substantially iron-saturated aqueous phosphoric acid solution from the chemical or electrochemical decontamination of superficially radioactively contaminated metal components is introduced into a supply of cold oxalic acid solution.

5. The method defined in claim 1 wherein the oxalic acid solution has an oxalic acid concentration of 5 to 15 weight percent.

6. The method defined in claim 5 wherein the oxalic acid solution has an oxalic acid concentration substantially 10 weight percent.

7. The method defined in claim 1 wherein the precipitated iron oxalate is recovered in step (b) by sedimentation.

8. The method defined in claim 1 wherein the precipitated iron oxalate is recovered in step (b) by filtration.

9. The method defined in claim 1 wherein precipitated iron oxalate is dried before being subjected to pyrolysis in step (c).

10. The method defined in claim 1 wherein in step (d), the liquid phase is subjected to evaporative concentration to a phosphoric acid content of substantially 40 weight percent.

11. The method defined in claim 1, further comprising the steps of condensing water from the evaporative concentration of the liquid phase, and preparing said oxalic acid solution with the condensed water.

12. A method of decontaminating metal components superficially contaminated with radioactivity, comprising the steps of:

(a) treating said metal components with a phosphoric acid solution to chemically or electrochemically pickle the metal components, remove surface radioactive contaminants therefrom and form a radioactive substantially iron-saturated aqueous phosphoric acid solution, said method comprising the steps of:

(b) combining said radioactive substantially iron-saturated aqueous phosphoric acid solution from the chemical or electrochemical decontamination of superficially radioactively contaminated metal components in step (a) with an aqueous oxalic acid solution and precipitating iron oxalate from a liquid phase of the combined solutions;

(c) recovering the precipitated iron oxalate from the combined solutions of step (b);

(d) conditioning the iron oxalate recovered in step (c) by pyrolysis to form a storable residue, and storing said residue;

(e) subjecting the liquid phase from step (b) from which the precipitated iron oxalate is recovered to evaporative concentration of the phosphoric acid therein and to form a recovered phosphoric acid solution with a phosphoric acid content of substantially 15 to 65 weight percent; and (f) recycling said recovered phosphoric acid solution to step (a) for decontaminating further superficially radioactively contaminated metal components.

13. The method defined in claim 12, further comprising the step of subjecting the radioactive substantially iron-saturated aqueous phosphoric acid solution from the chemical or electrochemical decontamination of superficially radioactively contaminated metal components prior to step (b) to a reductive treatment for converting up to at least 80% of the iron therein to its divalent form.

14. The method defined in claim 13 wherein the reduction is carried out electrochemically in a stainless steel vessel connected as a cathode against a graphite anode immersed in the radioactive phosphoric acid solution and surrounded by a diaphragm.

15. The method defined in claim 12 wherein, in step (b), the radioactive substantially iron-saturated aqueous phosphoric acid solution from the chemical or electrochemical decontamination of superficially radioactively contaminated metal components is introduced into a supply of cold oxalic acid solution.

16. The method defined in claim 12 wherein the precipitated iron oxalate is recovered in step (c) by sedimentation.

17. The method defined in claim 12 wherein the precipitated iron oxalate is recovered in step (c) by filtration.

18. The method defined in claim 12 wherein precipitated iron oxalate is dried before being subjected to pyrolysis in step (d).

19. The method defined in claim 12 wherein in step (e), the liquid phase is subjected to evaporative concentration to a phosphoric acid content of substantially 40 weight percent.

20. The method defined in claim 12, further comprising the steps of condensing water from the evaporative concentration of the liquid phase, and preparing said oxalic acid solution with the condensed water.

* * * * *